United States Patent [19]

Goldberg

[11] Patent Number: 4,914,879

[45] Date of Patent: Apr. 10, 1990

[54] PREFABRICATED BUILDING SYSTEM

[76] Inventor: Howard Goldberg, 211 Chestnut Ridge Rd., Woodcliff Lake, N.J. 07675

[21] Appl. No.: 208,346

[22] Filed: Jun. 17, 1988

[51] Int. Cl.[4] ..... E04B 2/76; E04B 1/18; E04C 1/10

[52] U.S. Cl. ..... 52/242; 52/264; 52/586; 52/293; 52/282

[58] Field of Search ..... 52/586, 807, 281, 264, 52/293, 241, 282, 284, 242

[56] References Cited

U.S. PATENT DOCUMENTS

| | | | |
|---|---|---|---|
| 2,257,296 | 9/1941 | Goldsmith | 52/242 |
| 2,699,669 | 1/1955 | Nelsson | 52/241 X |
| 2,730,209 | 1/1956 | Larsen | 52/264 X |
| 3,120,031 | 2/1964 | Bonshack | 52/281 X |
| 3,160,248 | 12/1964 | Galajikian | 52/293 X |
| 3,170,269 | 2/1965 | Dunnington | 52/293 |
| 3,254,464 | 6/1966 | Hoyt, Jr. | 52/586 X |
| 3,320,710 | 5/1967 | Byssing | 52/481 |
| 3,388,514 | 6/1968 | Archinal et al. | 52/293 X |
| 3,460,302 | 8/1969 | Cooper | 52/242 |
| 3,603,049 | 9/1971 | Pierce | 52/586 X |
| 3,640,039 | 2/1972 | McKee et al. | 52/586 X |
| 4,176,504 | 12/1979 | Huggins | 52/293 X |
| 4,625,476 | 12/1986 | Shimada | 52/586 X |

FOREIGN PATENT DOCUMENTS

| | | | |
|---|---|---|---|
| 244039 | 12/1965 | Austria | 52/281 |
| 274311 | 12/1968 | Austria | 52/264 |
| 2524972 | of 1976 | Fed. Rep. of Germany | 52/242 |
| 2646231 | 2/1977 | Fed. Rep. of Germany | 52/281 |
| 1466467 | 1/1967 | France | 52/281 |

*Primary Examiner*—David A. Scherbel
*Assistant Examiner*—Anthony W. Williams
*Attorney, Agent, or Firm*—Klauber & Jackson

[57] ABSTRACT

A building system includes prefabricated wall panels formed from steel studs, the panels being provided with supporting runners on their inner and outer sides, which runners have a first web lying along a side of the panel and a second web forming an extension of the side of the panel and cooperating with a shoe constructed to be secured to a supporting surface and having a body received between the second webs of the runners. Corner and intermediate columns are provided and the ends of the wall panels are constructed to mate with the corner and intermediate column to ensure a unified construction.

14 Claims, 7 Drawing Sheets

PREFABRICATED BUILDING SYSTEM

FIELD OF THE INVENTION

This invention relates to a building system and is more particularly concerned with a building system employing prefabricated wall panels fabricated with steel studs.

BACKGROUND OF THE INVENTION

The prefabrication of buildings for housing has been known for many years, and prefabricated wall panels of various types have been proposed. These prior systems, however, have, for the most part, been formed from wooden studs to simulate conventional wooden frame construction. While effective for their intended purpose, they have well-recognized drawbacks and disadvantages. Steel studs for wall construction are known, but steel studs present problems in home construction, particularly when it is desired to coordinate them with wooden or concrete members, and there is a need for an effective building system embodying readily-attached prefabricated, wall panels containing steel studs. A wall formed from steel studs has many advantages over conventional wood framing commonly used for home building and housing projects. The coated steel components will not warp, shrink or swell, are less likely to cause nail pops or plaster cracks due to movement, and they provide an incombustible building frame. Concern about climatic changes causing rot or other damage is not a problem, regardless of location. Steel members, unlike wood members, are free from imperfections such as knots and cracking.

OBJECTS OF THE INVENTION

It is, accordingly, an object of the invention to provide an improved building system which avoids the drawbacks and disadvantages of previously proposed systems.

It is another object of the invention to provide an improved building system of the character indicated which is particularly suited for residential home construction.

It is a further object of the invention to provide an improved building system of the nature specified which embodies steel studding.

It is a still further object of the invention to provide prefabricated wall panels for residential home construction containing steel studs and constructed for easy and rapid assembly.

It is another object of the invention to provide a joint structure to connect prefabricated wall panels containing steel studs to the remainder of the building structure.

SUMMARY OF THE INVENTION

In accordance with the invention, there is provided a building system comprising a plurality of prefabricated wall panels formed from steel studs and having inner and outer sides and top and bottom edges, the panels being provided with supporting runners along their top and bottom edges on their inner and outer sides, which runners each has a first web lying along a side of the panel and a second web forming an extension of the side of the panel, and each runner cooperating with a shoe constructed to be secured to a supporting surface and having a body received between the second webs of the runners. Advantageously, corner and intermediate columns are provided, and the ends of the wall panels of the invention are constructed to mate with the corner and intermediate columns to ensure a unified construction. The building system may also comprise metal joists underlying or overlying the supporting surfaces for the wall panels; the metal joists and wall panels may also define a building unit or module, and multi-story assemblies are also contemplated.

BRIEF DESCRIPTION OF THE DRAWINGS

Other objects and features of the invention will be readily apparent from the following detailed description and from the accompanying drawings, wherein.

DESCRIPTION OF A PREFERRED EMBODIMENT

Figure 1:
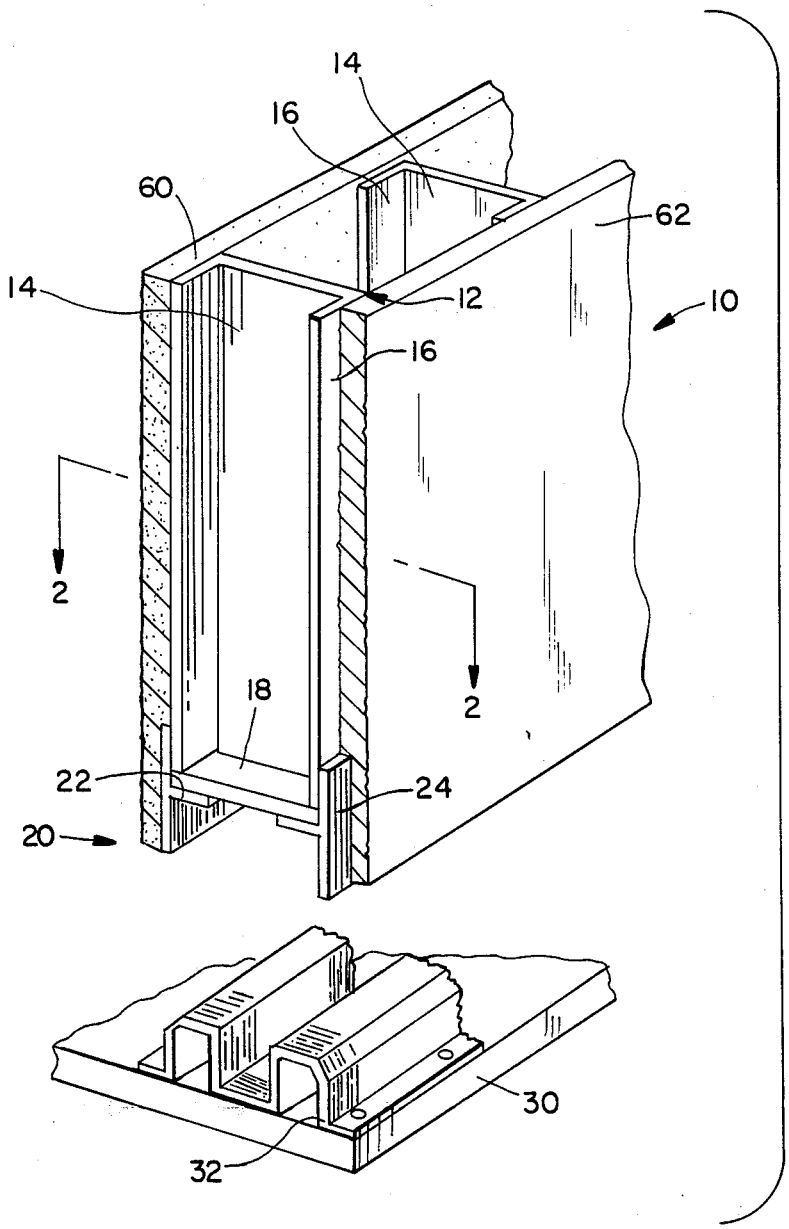
FIG. 1 is a fragmentary perspective view of a portion of a prefabricated wall panel embodying features of the present invention, showing its connection to a supporting surface.

Referring now to FIG. 1, a prefabricated panel and mounting assembly in accordance with the invention comprises a wall panel unit 10 formed from a plurality of spaced-apart vertical steel studs 12 of generally U-shaped cross section, each having a transverse web 14 and two right angular wings or sides 16. The studs 12 can be formed, for example, of 18 or 20 gauge steel sheet. The steel studs may rest upon a plate 18 as shown, or may sit directly upon and in either event are joined adjacent their ends by brackets or "runners" 20, formed e.g., from metal of suitable thickness and strength, for example, 16 gauge steel sheet. The runners 20 extend the length of the wall panel 10 on each side of it and have a generally T-shaped cross section. The leg 22 of each runner 20 underlies either the plate 18 or makes direct contact with the adjacent end of the studs, while the crossbar 24 of the T overlies a wing or side 16 of each stud and is secured to it, as by welding, and also extends below the wall panel and parallel to it, the crossbar 24 thus has an upper portion providing a first web which lies along the sides or wings of the studs and a bottom portion providing a second web which forms an extension of the sides or wings of the studs and thereby of the panel for a reason which will be discussed below.

Under wall panel 10, and suitably secured to the underlying support surface 30, e.g., the flooring of the house, is a base unit bracket or "shoe" 32 which is dimensioned to be received in the lateral space between the downwardly-extending portions of the crossbars 24 of the runners 20. Like the runners 20, the base shoe also extends the length of wall panel 10 and can likewise be formed, for example, of 16 gauge steel sheet. As seen more particularly in FIG. 2, the base shoe 32 has a top wall 34 and sidewalls 36, each of which has an outwardly-extending flange 38 at its end which rests upon the supporting surface 30. The lateral free space between the wings 16 of steel studs 12 may be suitably filled with insulation, e.g., fiberglass batts, and in this embodiment, in order to complete the insulation of the wall, since the crossbars 24 extend below plate 18 and leave a void between them, the top wall of base shoe 32 is formed with a depression or channel 40 which extends to the support surface 30 and is filled with insulation of any desired type, most suitably a rigid insulation 42.

Figure 2:
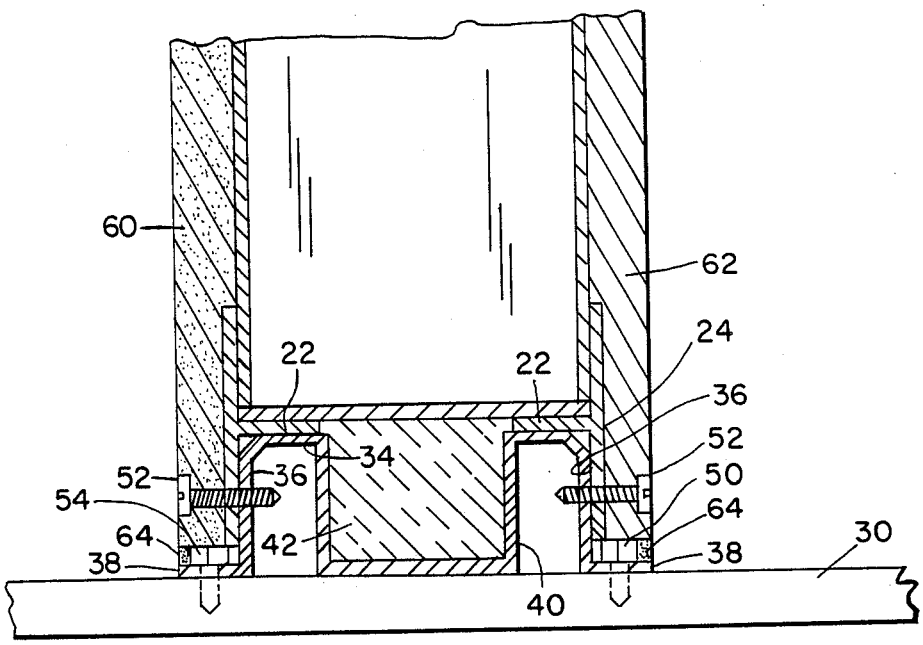
FIG. 2 is a vertical section of the prefabricated system of the invention taken approximately along the line 2—2 of FIG. 1.
Figure 5:
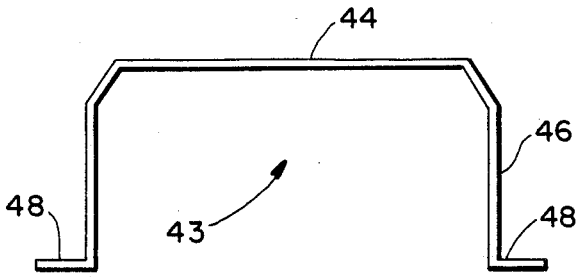
FIG. 5 is a vertical cross section of a base unit in accordance with another embodiment of the invention, particularly suitable for interior wall installation.

The embodiment of FIGS. 1 and 2 is constructed for use as an exterior wall. Referring to FIG. 5, there is shown, in section, a base shoe 43 constructed for an interior wall, where insulation is not a problem. In this case, the top wall 44, corresponding to top wall 34, is continuous and has no channel. The sidewalls 46 and flanges 48 are identical with the sidewalls 36 and the flanges 38 of the exterior wall shoe 32 shown in FIGS. 1 and 2.

Figure 8:
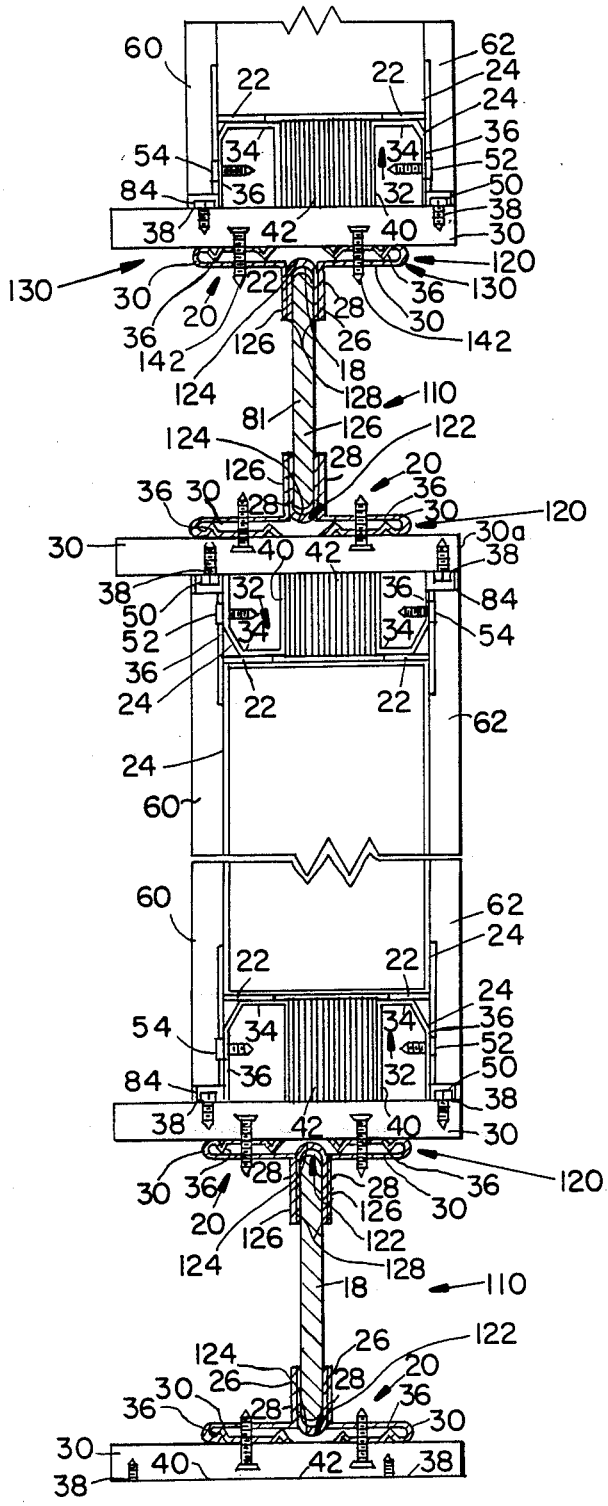
FIG. 8 is a partial cross-section of a multi-story building embodying wall panels in accordance with the present invention spaced by joist-like structural members.

To mount the prefabricated wall panel 10, the base shoe 32 (or 43) is secured to the supporting surface 30 by any convenient means, such as lag bolts 50, which may pass through apertures in flanges 38 (or 48), and the wall panel 10 is then seated upon the shoe and secured to it by means of screws 52 which connect crossbars 24 of runners 20 to the sidewalls of the shoe, e.g., the sidewalls 36 of shoe 32. An identical assembly is suitably provided at the top of panel 10 to join it to the upper supporting surface, as seen in FIG. 8. Naturally, other fastening means known in the art are contemplated, and the foregoing is presented as illustrative only.

In other words, there is provided a unique fastening system for prefabricated housing construction which can be defined as comprising a first component comprising means defining a channel for attachment to the bottom or top of a wall panel and a second component comprising a cooperating runner for attachment to a supporting surface, the runner of the second component being received in the channel of the first component.

The panel 10 shown in FIGS. 1 and 2 is constructed as an outside panel, as mentioned, and is faced as a drywall 60 on its inside surface and with plywood 62 on its exterior surface. The drywall 60 is suitably applied when the panel 10 is constructed. The outer facing 62 can be applied when the wall panel 10 is initially fabricated, which is preferred, or it can be applied after the panel 10 is mounted in position on shoe 32. When the outer facing is applied during initial fabrication, openings can be left for access to screws 52 which can thereafter be filled with spackle, caulk, etc. Caulk 64 can also be applied to seal the joint between the supporting surface 30 and the facings 60 and 62.

Figure 3:
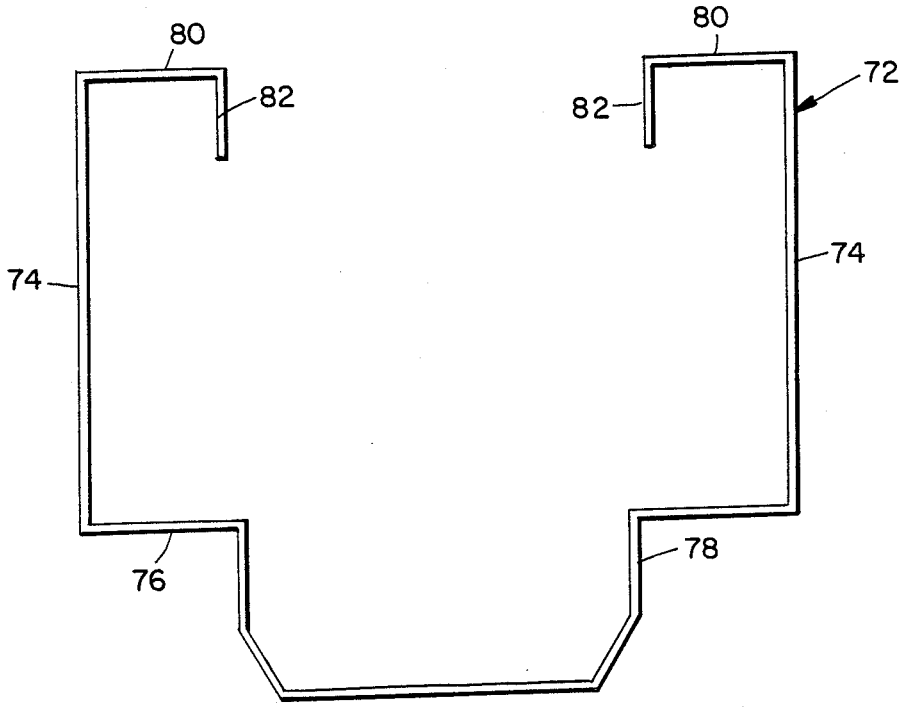
FIG. 3 is a horizontal cross section of a column constructed to receive an interior wall panel.
Figure 7:
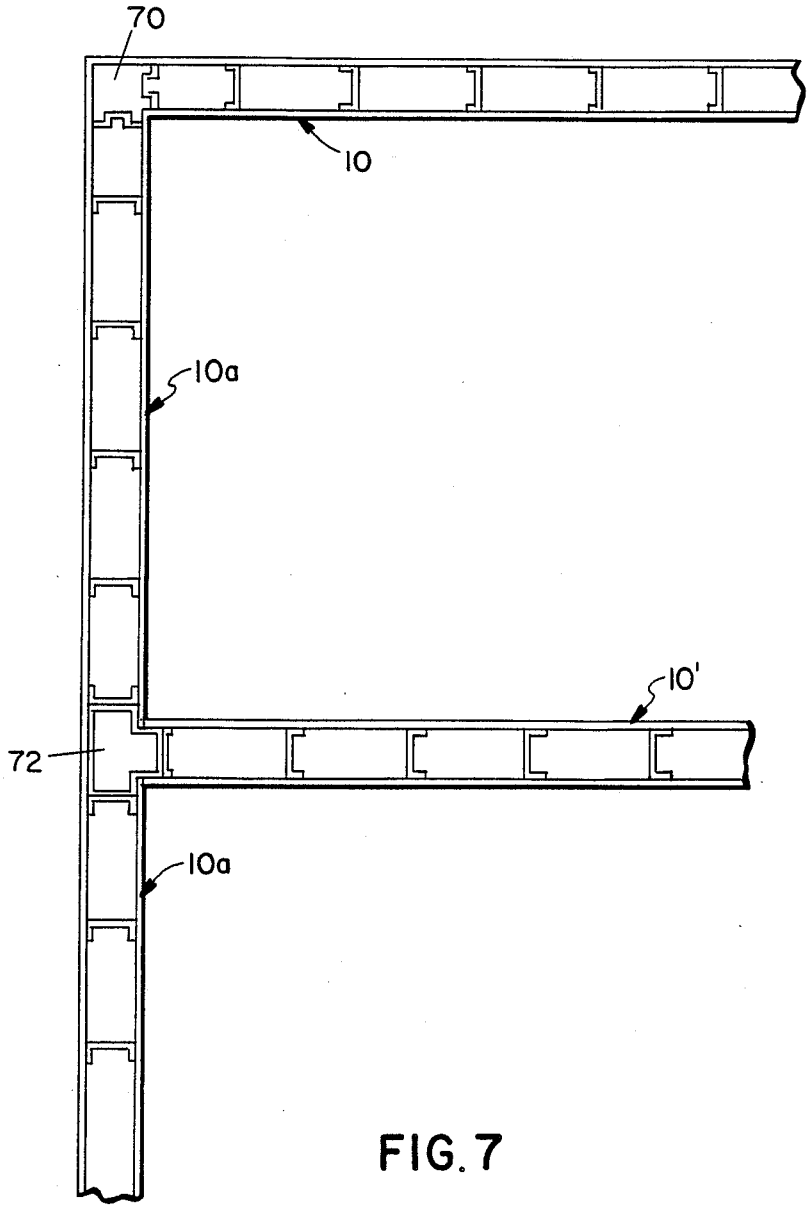
FIG. 7 is a fragmentary horizontal cross section of a multiple wall assembly embodying features of the present invention.

Referring now to FIG. 7, there will be seen a fragmentary assembly of panels 10, such as would be seen in a typical home construction, showing three of them along the outside wall and one of them as an interior partition wall. Posts are provided for the juncture and connection of the outside walls at the corners, and posts are also provided for use between panels for connection to an inside partition panel. Thus, as seen in FIG. 7, there is provided a corner post or column 70, and a post or column 72 for connection to an interior or partition wall panel. These columns 70 and 72 are shown in more detail in cross section in FIGS. 3 and 4. Thus, referring to FIG. 3, column 72, which is suitably formed from 20 gauge steel sheet which is shaped to give it a generally rectangular cross section has sidewalls 74, a front wall 76 formed at its center with a protuberance 78, and rear walls 80 which are bent inwardly near their ends to form wings 82 to provide added strength to the column. As will be seen in FIG. 7, the end stud in the partition wall panel 10' which is constructed as described in connection with wall panel 10, except that it is faced on both sides with dry wall, has its wings 16 extending toward the end of the panel so that there is formed at the panel end a recess for reception of the protuberance 78 of intermediate column 72, which is positioned in the sidewall between two outside panels **10*a*. At the junction between the outside panels 10*a*, which are like panel 10 in construction, and the intermediate column 72, the end stud in each adjacent panel is positioned with its wings 16 extending inwardly so that the web 14 of each wall panel 10*a* forms the end of the panel for abutting relationship with column 72**.

Figure 4:
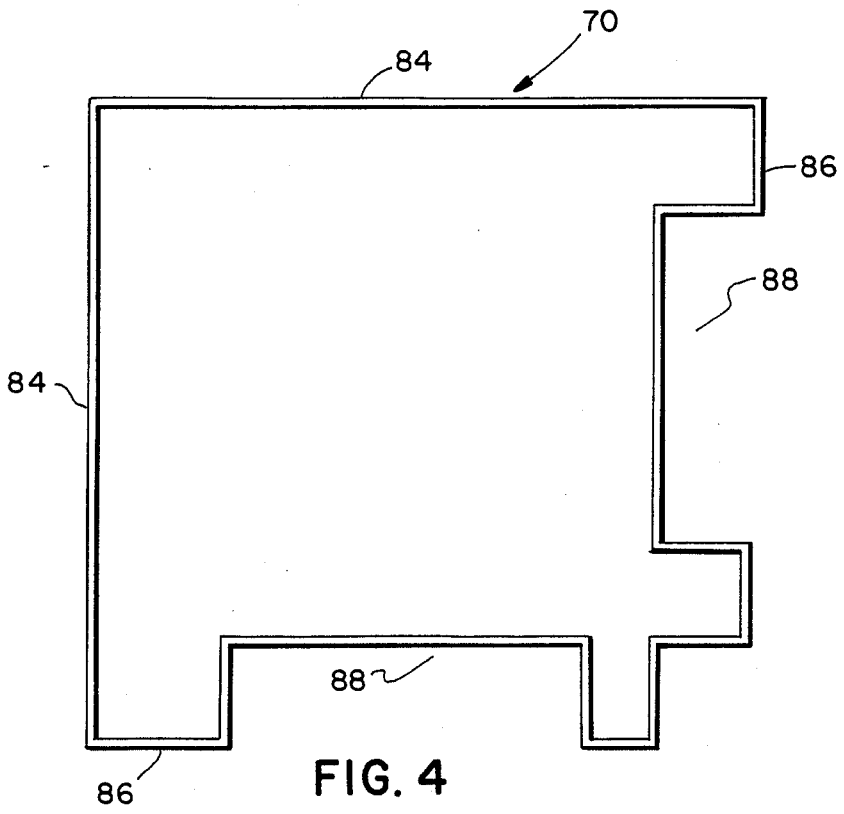
FIG. 4 is a horizontal cross section of a column constructed to receive exterior wall panels.

Referring now to FIG. 4, there is shown, in section, corner column 70 which, like intermediate column 72, is advantageously formed from 20 gauge steel sheet suitably bent and shaped to give the column 70 a substantially rectangular cross section, with two outside walls 84 and inside walls 86, with the latter being shaped to define recesses 88 for cooperating with outside wall panels 10 and **10*a***, as will be described below.

Figure 6:
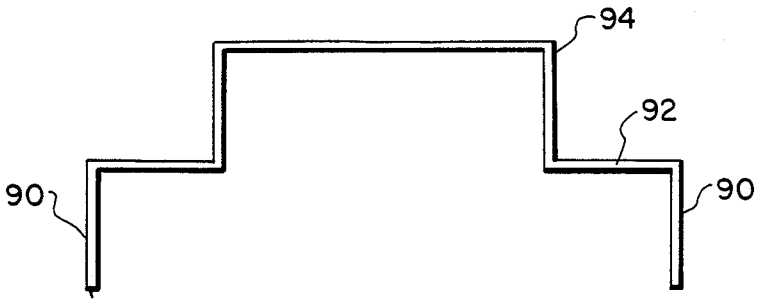
FIG. 6 is a horizontal cross section of the corner end stud of an exterior wall panel embodying features of the invention.

Referring now to FIG. 6, in order to provide for mating relationship with the corner column 70, the end studs of the cooperating panels 10 and **10*a* which engage corner column 70 are, as shown in FIG. 6, shaped and positioned so that their wings 90 extend inwardly and their webs 92 are formed to define a protuberance 94 which extends from the end of the panel and fits into the recesses 88, so that the front and side outside panels 10 and 10*a* are essentially locked into place in engagement with the column 70**.

Figure 9:
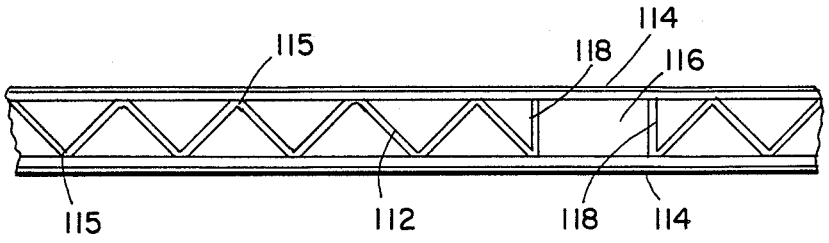
FIG. 9 is a side elevation of a joist-like structural member as shown, in FIG. 8.

It is contemplated that a principal use of the wall panels will be in a total prefabricated construction assembly which includes not only the wall panels as hereinbefore described but also includes flooring and ceiling constructions and joists or girders, and even includes multi-story assemblies, as seen in FIG. 8. The joists or girders used are most advantageously of the construction disclosed in my co-pending application being filed concurrently herewith and entitled "Structural Member," the disclosure of which is incorporated herein by reference. As disclosed in that application, and as seen in FIGS. 8 and 9 hereof, the structural member or joist 110 has a web 112 and flanges 114 at each edge of the web, i.e., upper and lower flanges. In the embodiment illustrated, the web 112 is formed from a continuous rod which is bent as illustrated so that it forms a plurality of peaks 115 and extends between the webs 114 at acute angles except for an area where an opening 116 is left, and the bent rod portions outlining this area 116 extend substantially perpendicularly between the flanges 114, as indicated at 118.

As seen particularly in FIG. 8, each web is formed from a single continuous steel sheet, e.g., of 20 gauge, although it may be of any convenient thickness, which is bent and folded upon itself in a particular manner, as shown in the drawing. Thus, the sheet, indicated generally by reference 120, is folded upon itself adjacent its center to define a socket or channel 122 extending the length of the member 110. Thus, as illustrated, the sheet 120, when shaped and folded, has a central arcuate rib 124 which joins with sidewalls 126 to define the socket or channel 122. The socket 122 can be effectively formed by rolling. It is a feature of the invention that the lower ends of the sidewalls are retroverted so that the metal sheet is folded upon itself and defines a secondary wall 128 which overlies and effectively reinforces wall 126. Near the top of socket 122, the metal on each side is bent at right angles to define wings 130 of the flange 114 illustrated. The metal at the ends of the wings 130 is retroverted and folded upon itself to define secondary wings 132 which terminated short of the rib 124 but have a retroverted end 134 and are formed with a central depression 136. The retroverted end 34 and the central depression serve to space the secondary wings 132 a slight distance from wings 130 at the level of rib 124.

Again referring to FIG. 8, when the member 120 is employed as a joist, means providing a supporting surface, e.g., flooring 30, is readily nailed to it by means of appropriate fasteners such as sheet metal screws 32, such as conventionally used with metal, and these screws penetrate both the wings and the secondary wings, to give the nails exceptional holding power. The member 110 can similarly have ceiling supports, e.g., plywood, attached to it.

Figure 10:
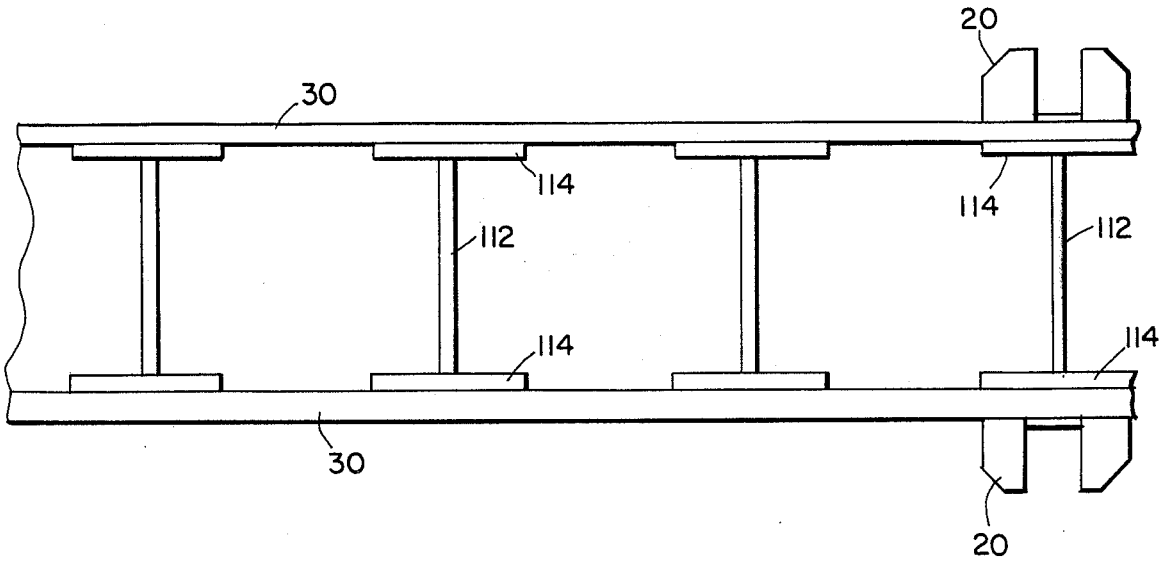
FIG. 10 is a partial diagrammatic side elevation of a supporting assembly suitable for use in the building system of the invention.

In other words, both flanges can have means providing supporting surfaces attached to them, e.g., subflooring boards, plywood, and the like. It is contemplated that a supporting assembly to which the tops or bottoms of the wall panels can be attached can be constructed from a plurality of parallel, spaced-apart joist members 110 to both flanges of which are fastened supporting surface units. Such a unit is shown diagrammatically in part in FIG. 10. In the case of a first-floor floor joist, only its top flange would have flooring fastened to it and its lower flange would be secured to a foundation member, rest up a sill, or the like. If desired, as shown in FIG. 10, the supporting assembly could have one or more of the runners for the wall panel units, such as, the runners 20 shown, pre-attached to it for instant connection of the wall panels 10 in erecting a house.

Referring again to the support member 110 specifically, the rod 18 is dimensioned to be snugly received in socket 112, but ordinarily it is advantageous to ensure a firm connection by means of welding, or the like. In the embodiment of FIG. 9, the open area 116 wherein the vertical portions 118 of the rod 112 are interconnected within the socket 122, may be omitted, and the rod 112 may be bent at reverse right angles, as shown at the left of FIG. 9, throughout its length, but it is highly preferred to have the open area 16 available for construction purposes.

As described in the copending application, it is contemplated that both flanges have means providing supporting surfaces 30 screw-fastened to them, e.g. subflooring boards, plywood, and the like. It is contemplated that a supporting assembly to which the tops or bottoms of the wall panels can be attached can be constructed from a plurality of parallel, spaced-apart joist members 110 to both flanges of which are nailed supporting surface units. Such a unit is shown diagrammatically, in part, in FIG. 4. In the case of a first-floor floor joist, only its top flange would have flooring nailed to it and its lower flange would be secured to a foundation member, rest up a sill, or the like.

As will be apparent from the foregoing description, the structural member just described is of relatively uncomplicated construction; and is formed from a minimum of pieces; yet, it is lightweight, strong, capable of having flooring and the like securely affixed to it, and it is particularly characterized by being easy to manufacture at a relatively low cost.

In the assembly of FIG. 8, flooring 30 is secured by nails or screws to joists, such as the metal joists just described, wherein the nails 142 are driven through the upper wings or flanges 130 of the structural members 110. A plurality of members 110 will underlie the flooring, as do wooden joists in a conventional frame construction, and as in the supporting assemblies referred to above. The prefabricated walls above described with their mating shoes 32 are assembled upon the runner-containing joist-supported supporting surfaces which provide the floor and ceiling of the assembled structure. The floor and ceiling are supported by sets of structural members 110. The actual ceiling components, e.g., tiles, plasterboard, and the like are suitably attached, e.g., by nailing or adhesively, to the support structures carried by flanges 130 of members 110. In multiple-story construction, as seen in FIG. 8, shoes 32 are nailed not only to the underside of the supporting assembly at the top of panels 10, comprising a ceiling support and also an overlying support structure, but to the overlying support structure as well, and additional wall panels 10, with their runners 20 are mounted upon the additional shoes 32, etc., to provide a multi-story building assembly.

Thus, this invention contemplates not only prefabricated wall panels and pre-fabricated supporting assemblies as above described, but also a prefabricated building unit comprising preassembled adjacent wall, floor and ceiling assemblies which can be brought, e.g., trucked, to the site and erected upon a suitable foundation. The prefabricated building unit most preferably consists of a complete room or a plurality of rooms, one or more stories in height, constructed as hereinabove described. In other words, the invention provides a prefabricated construction module.

Each module is preferably provided with electrical outlets, switches, cable, and the like, already installed in it, as well as all plumbing fixtures and plumbing lines, so that only appropriate connections to supply lines and sewers need to be made at the site.

As a result of this construction, there is provided a rapidly assemblable, sturdy, prefabricated building system characterized by side and partition wall panels which securely interengage with shoes which are securely fastened to supporting surfaces and the ends of the panels securely interengage with vertically extending columns that are generally preassembled to the longest wall in the particular assembly, all being readily prefabricated and brought to the building site where they can be assembled in minimum time and with minimum manpower. Alternatively, the building panels can be preassembled with flooring and ceiling units and associated joists, such as the structural members hereinabove described, to provide building modules or units of one or more floors and defining one or more rooms. The time necessary to erect each house is greatly reduced and can be accomplished utilizing assembly personnel. The system will meet the design criteria of national building codes and HUD requirements. Further, it reduces loads on foundations and can be readily adapted to more than adequately support any loading commonly found in residential construction.

It will be obvious that various changes and modifications may be made without departing from the invention as defined in the appended claims, and it is intended therefore that all matter contained in the foregoing description and in the drawings shall be interpreted as illustrative only and not as limitative of the invention.

What is claimed is:

1. A building system comprising a plurality of prefabricated wall panels formed from steel studs having inner and outer sides and top and bottom edges, said panels being provided with supporting runners along said bottom edges on said inner and outer sides, said runners interconnecting said steel studs and having a first web lying along said edges of the sides of said studs and a second web forming an extension of said sides of said studs, and a cooperating shoe constructed to be secured to a supporting surface and having a body received between the second webs of said runners.

2. A building system as defined in claim 1, further comprising a column at the corner junction between two of said plurality of panels, and means for causing said two panels to interengage and interlock with said column.

3. A building system as defined in claim 2, wherein said means for causing interengagement and interlocking comprises an end stud in each of said two panels having a longitudinal protuberance and said column being formed with longitudinal recesses positioned to receive and engage said protuberances and to interlock therewith without fastening means.

4. A building system as defined in claim 1, further comprising a column disposed between the ends of two of said plurality of panels, a third one of said plurality of panels extending at right angles to said two panels at said column, and means for causing said third panel to interengage with said column.

5. A building system as defined in claim 4, wherein said means comprises an end stud in said third panel constructed to define a recess at the end of said third panel, and said column is formed with a longitudinal protuberance facing said third panel and positioned to engage said recess.

6. A building system as defined in claim 1, wherein said shoe has a flange on each of its sides underlying the second webs of the panel and securing means are driven through said flanges into the supporting surface.

7. A building system as defined in claim 1, wherein said second webs of said runners are secured to said shoe.

8. A building system as defined in claim 1, wherein said steel studs are formed from steel sheet and shaped to define a longitudinal transverse web and lateral wings extending at right angles thereto.

9. A prefabricated building wall comprising a prefabricated panel formed from steel studs having inner and outer sides and top and bottom edges, said panel being provided with supporting runners interconnecting said steel studs and having a web lying along said sides of said studs at least at the bottom edges of said panel and a second web forming an extension of said sides of said studs, and a cooperating shoe constructed to be secured to a supporting surface and having a body received between the second webs of said runners which extend from the sides of said studs.

10. A prefabricated building wall as defined in claim 9, wherein said shoe has a flange on each of its sides and securing means are driven through said flanges into the supporting surface.

11. A prefabricated building wall as defined in claim 9, wherein said second webs of said runners are secured to said shoe.

12. A prefabricated building wall as defined in claim 9, wherein said steel studs are studs formed from steel sheet and shaped to define a longitudinal transverse web and lateral wings extending at right angles thereto.

13. A fastening system for pre-fabricated housing construction wherein a wall panel formed from studs having side walls and lower surfaces is mounted between a bottom supporting surface and a top supporting surface, which comprises in combination said panel and a first component comprising walls defining a channel for attachment to the outer surfaces of the sidewalls of said studs and a second component comprising a cooperating shoe for attachment of a one of said supporting surfaces the shoe of the second component being received in the channel of the first component, the shoe having top and sidewalls overlain by said walls of said channel, and flanges at the edges of the sidewalls of said shoe and underlying said channel walls for receiving means for attachment to one of said supporting surfaces.

14. A building system as defined in claim 1, further comprising second runners provided along said top edges of said studs, said second runners interconnecting said steel studs and having a first web lying along the surfaces of the sides of said studs, and a second web forming an extension of the sides of said studs, and a second cooperating shoe constructed to be secured to a supporting surface and having a body received between the second webs of said second runners.

* * * * *